US010202182B2

(12) United States Patent
Ito et al.

(10) Patent No.: US 10,202,182 B2
(45) Date of Patent: Feb. 12, 2019

(54) WATERCRAFT CONTROL METHOD AND WATERCRAFT CONTROL SYSTEM

(71) Applicant: YAMAHA HATSUDOKI KABUSHIKI KAISHA, Iwata-shi, Shizuoka (JP)

(72) Inventors: Makoto Ito, Shizuoka (JP); Mathias Lindeborg, Gothenburg (SE); Sebastian Nilsson, Gothenburg (SE)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 32 days.

(21) Appl. No.: 15/342,155

(22) Filed: Nov. 3, 2016

(65) Prior Publication Data

US 2017/0144740 A1 May 25, 2017

(30) Foreign Application Priority Data

Nov. 25, 2015 (JP) ..... 2015-229586

(51) Int. Cl.
*B60L 3/00* (2006.01)
*B63H 21/21* (2006.01)
(Continued)

(52) U.S. Cl.
CPC ..... *B63H 21/213* (2013.01); *B63H 21/21* (2013.01); *B63H 25/02* (2013.01); *B63H 25/42* (2013.01);
(Continued)

(58) Field of Classification Search
CPC ..... B63H 21/21; B63H 21/213; B63H 25/02; B63H 25/42
(Continued)

(56) References Cited

U.S. PATENT DOCUMENTS 7,877,174 B2 * 1/2011 Walser ..... B63B 49/00 440/1
8,145,371 B2 * 3/2012 Rae ..... B63H 11/107 701/21
(Continued)

FOREIGN PATENT DOCUMENTS

EP 2 371 703 A1 10/2011
JP 2009-255769 A 11/2009
JP 2010-203416 A 9/2010

OTHER PUBLICATIONS

Ito et al., "Watercraft Control Method and Watercraft Control System", U.S. Appl. No. 15/956,907, filed Apr. 19, 2018.

*Primary Examiner* — Thomas G Black
*Assistant Examiner* — Luat Huynh
(74) *Attorney, Agent, or Firm* — Keating and Bennett, LLP

(57) ABSTRACT

In a first step of a watercraft control method, a command signal to activate an automatic cruise function is received. In a second step, a target vessel velocity of a watercraft is set. In a third step, an actual vessel velocity of the watercraft is obtained. In a fourth step, a command signal is generated that is a signal to perform an automatic cruise control to control a thrust of the watercraft such that a difference between the target vessel velocity and the actual vessel velocity falls in a predetermined range of values. In a fifth step, it is determined whether or not a predetermined interruption condition has been established. In a sixth step, a command signal is generated that is a signal to perform the automatic cruise control with the thrust having a different magnitude from the thrust to be generated under normal circumstances without establishment of the interruption condition when the interruption condition has been established.

13 Claims, 11 Drawing Sheets

(51) Int. Cl.
*B63H 25/02* (2006.01)
*B63H 25/42* (2006.01)
*B63J 99/00* (2009.01)

(52) U.S. Cl.
CPC .. *B63H 2021/216* (2013.01); *B63H 2025/024* (2013.01); *B63J 2099/008* (2013.01)

(58) Field of Classification Search
USPC ..... 701/21
See application file for complete search history.

(56) References Cited

U.S. PATENT DOCUMENTS

| | | | | |
|---|---|---|---|---|
| 9,487,139 | B1 * | 11/2016 | Ishida | B60W 50/14 |
| 2004/0242091 | A1 * | 12/2004 | Okuyama | B63H 21/21 440/86 |
| 2009/0069962 | A1 * | 3/2009 | Aharon | B63C 11/42 701/21 |
| 2010/0198435 | A1 * | 8/2010 | Cansiani | B63B 39/061 701/21 |
| 2013/0110329 | A1 * | 5/2013 | Kinoshita | B63H 25/02 701/21 |

* cited by examiner

WATERCRAFT CONTROL METHOD AND WATERCRAFT CONTROL SYSTEM

BACKGROUND OF THE INVENTION

1. Field of the Invention

The present invention relates to a watercraft control method and a watercraft control system.

2. Description of the Related Art

As described in Japan Laid-open Patent Application Publication No. 2010-203416, keeping constant the rotation speed of an engine has been conventionally performed as a control to keep constant the velocity of a watercraft. By thus keeping constant the engine rotation speed highly related to the vessel velocity, the vessel velocity can be controlled to fall in a predetermined range.

However, even when the engine rotation speed is kept constant, the vessel velocity varies inevitably due to influence of waves, the tide, the wind and so forth or depending on whether or not a hydroplaning state is produced. Therefore, it is desirable to directly detect and control the vessel velocity so as to enhance as much as possible accuracy in keeping the vessel velocity constant.

For example, when the vessel velocity is accurately detectable by position measuring means such as a GPS function, the vessel velocity can be accurately kept constant by a feedback control to regulate a thrust in accordance with a difference between a target vessel velocity and an actual vessel velocity.

However, chances are that even when the feedback control is performed, a temporal decrease in vessel velocity is caused in, for instance, turning of the watercraft. For example, when the watercraft tows a water skier in a towing mode, a temporal decrease in vessel velocity may affect a hydroplaning state of the water skier.

Incidentally, when the actual vessel velocity deviates from the target vessel velocity under the feedback control, the actual vessel velocity can be automatically restored to the target vessel velocity. However, in increasing or decreasing the vessel velocity in a specific region, it is required to perform an additional action of deactivating an automatic cruise control and switching into a manual cruise control in the specific region.

SUMMARY OF THE INVENTION

Preferred embodiments of the present invention provide an automatic cruise function such that a velocity of a watercraft is controllable in accordance with a condition of a watercraft.

A watercraft control method according to a preferred embodiment of the present invention includes the following steps. In a first step, a command signal that enables an automatic cruise function is received. In a second step, a target vessel velocity of a watercraft is set. In a third step, an actual vessel velocity of the watercraft is obtained. In a fourth step, a command signal is generated that is a signal to perform an automatic cruise control to control a thrust of the watercraft such that a difference between the target vessel velocity and the actual vessel velocity falls in a predetermined range of values. In a fifth step, it is determined whether or not a predetermined interruption condition has been established. In a sixth step, a command signal is generated that is a signal to perform the automatic cruise control with the thrust having a different magnitude from the thrust to be generated under normal circumstances without establishment of the interruption condition when the interruption condition has been established.

A watercraft control system according to another preferred embodiment of the present invention includes a propulsion device, an automatic cruise controller, a target vessel velocity controller, a vessel velocity detector and a controller. The propulsion device is mounted to a watercraft. The automatic cruise controller is configured or programmed to generate a command signal to activate an automatic cruise function. The target vessel velocity controller is configured or programmed to set a target vessel velocity of the watercraft. The vessel velocity detector detects an actual vessel velocity of the watercraft. The controller is configured or programmed to perform an automatic cruise control to control a thrust of the propulsion device such that a difference between the target vessel velocity and the actual vessel velocity falls in a predetermined range of values. The controller is configured or programmed to determine whether or not a predetermined interruption condition has been established. The controller is configured or programmed to perform the automatic cruise control with the thrust having a different magnitude from the thrust to be generated under normal circumstances without establishment of the interruption condition when the interruption condition has been established.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
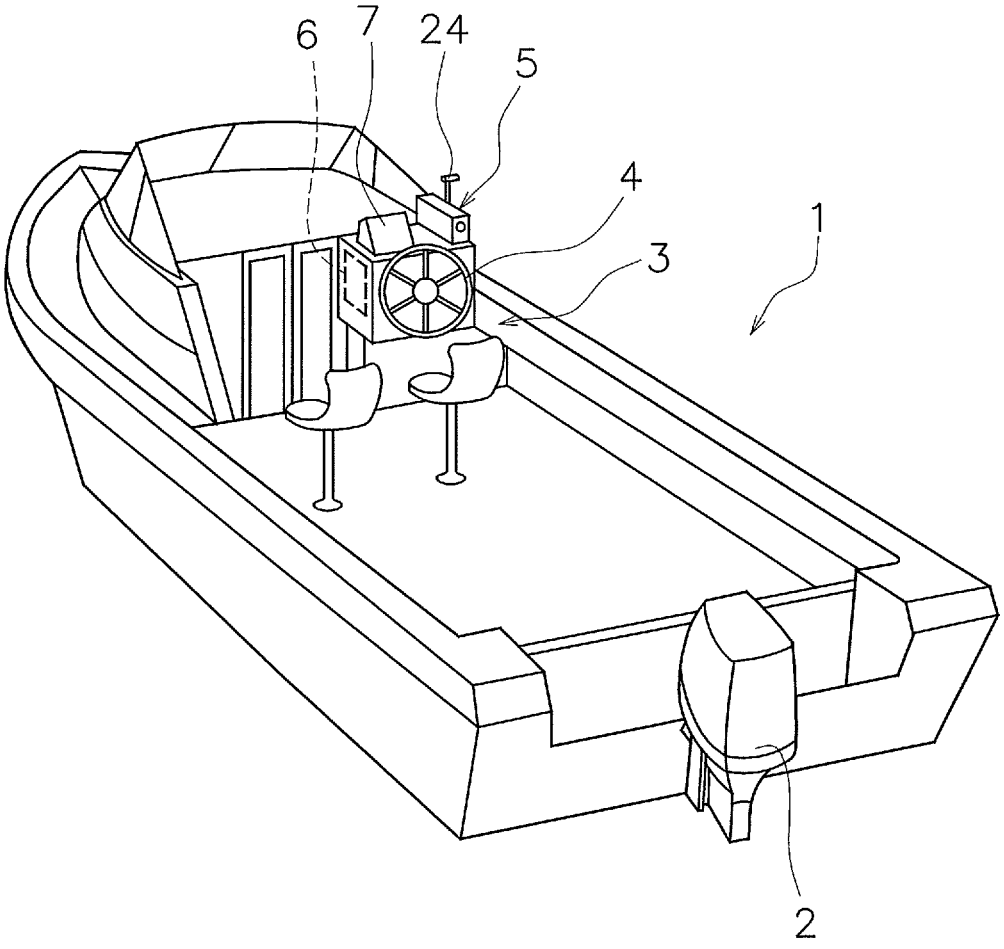
FIG. 1 is a perspective view of a watercraft according to a preferred embodiment of the present invention.

Preferred embodiments will be hereinafter explained with reference to the attached drawings. FIG. 1 is a perspective view of a watercraft 1 according to a preferred embodiment of the present invention. As shown in FIG. 1, a propulsion device 2 is mounted to the watercraft 1. In the present preferred embodiment, the propulsion device 2 preferably is an outboard motor, for example. It should be noted that the propulsion device 2 may be a type of device different from the outboard motor. For example, the propulsion device 2 may be a water jet propulsion device. The propulsion device 2 is attached to the stern of the watercraft 1. The propulsion device 2 generates a thrust to propel the watercraft 1. In the present preferred embodiments, the single propulsion device 2 is mounted to the watercraft 1, but alternatively, two or more propulsion devices may be mounted to the watercraft 1.

The watercraft 1 includes a vessel operating seat 3. A steering handle 4, a remote controller 5, a controller 6 and an automatic cruise operator 7 are disposed at the vessel operating seat 3. The steering handle 4 is a device that allows an operator to operate the turning direction of the watercraft 1. The remote controller 5 is a device that allows the operator to regulate the vessel velocity. Additionally, the remote controller 5 is a device that allows the operator to switch the moving direction of the watercraft 1 between the forward direction and the rearward direction. The controller 6 is configured or programmed to control the propulsion device 2 in accordance with an operating signal from the steering handle 4 and that from the remote controller 5. The automatic cruise operator 7 is a device that allows the operator to operate an automatic cruise function.

Figure 2:
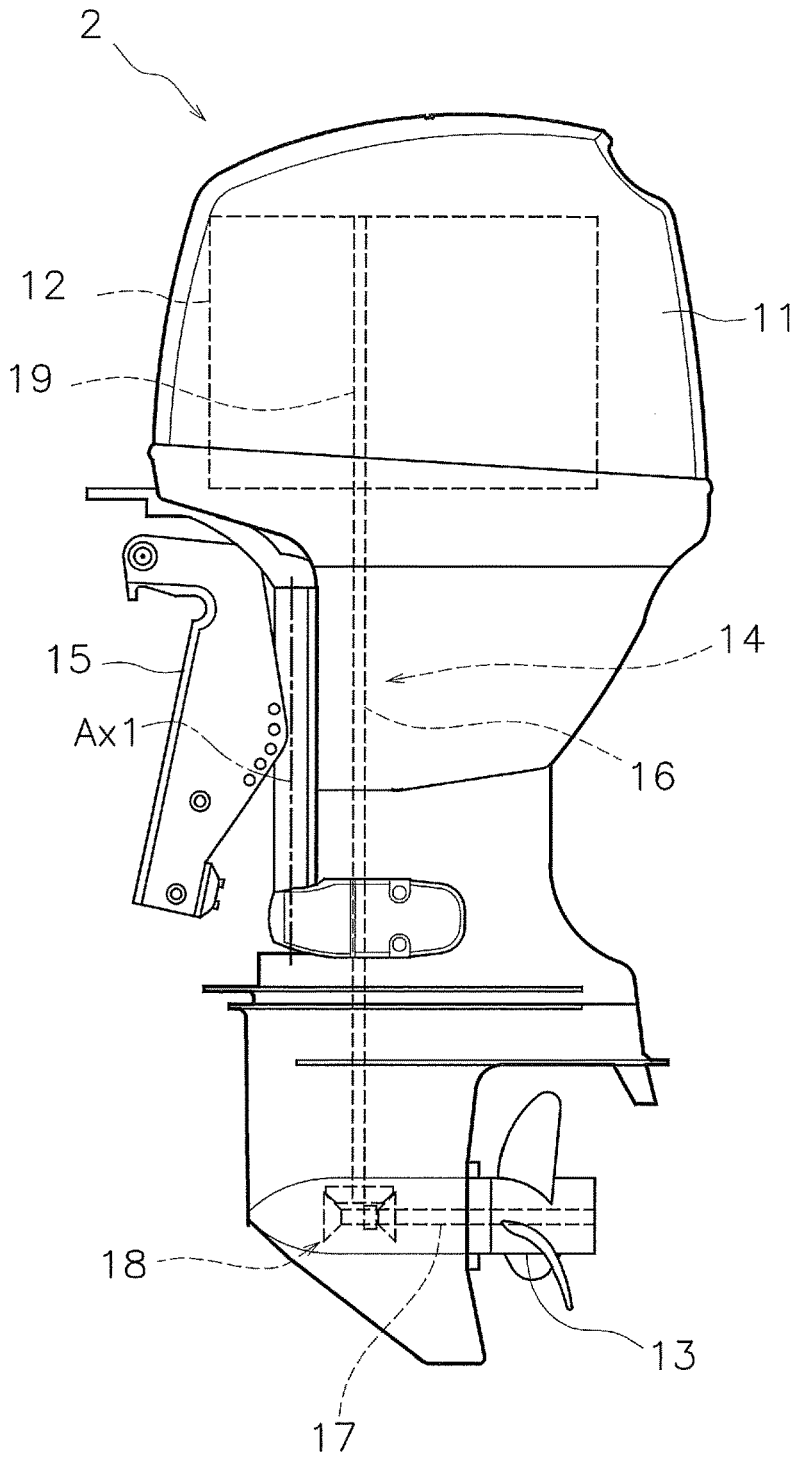
FIG. 2 is a side view of a propulsion device.

FIG. 2 is a side view of the propulsion device 2. The propulsion device 2 includes a cover member 11, an engine 12, a propeller 13 and a power transmission mechanism 14. The cover member 11 accommodates the engine 12 and the power transmission mechanism 14. The engine 12 is disposed in the upper portion of the propulsion device 2. The engine 12 is an exemplary power source to generate power to propel the watercraft 1. The propeller 13 is disposed in the lower portion of the propulsion device 2. The propeller 13 is driven and rotated by a driving force from the engine 12. The power transmission mechanism 14 transmits the driving force from the engine 12 to the propeller 13. The power transmission mechanism 14 includes a drive shaft 16, a propeller shaft 17 and a shift mechanism 18. The drive shaft 16 is disposed along the up-and-down direction.

The drive shaft 16 is coupled to a crankshaft 19 of the engine 12, and transmits the power from the engine 12. The propeller shaft 17 is disposed along the back-and-forth direction. The propeller shaft 17 is coupled to the lower portion of the drive shaft 16 through the shift mechanism 18. The propeller shaft 17 transmits the driving force from the drive shaft 16 to the propeller 13. The shift mechanism 18 switches the rotational direction of the power to be transmitted from the drive shaft 16 to the propeller shaft 17.

The propulsion device 2 is attached to the watercraft 1 through a bracket 15. The propulsion device 2 is pivotable about a steering axis Ax1 of the bracket 15 while being attached to the watercraft 1. A steering angle is able to be changed by pivoting the propulsion device 2 about the steering axis Ax1.

Figure 3:
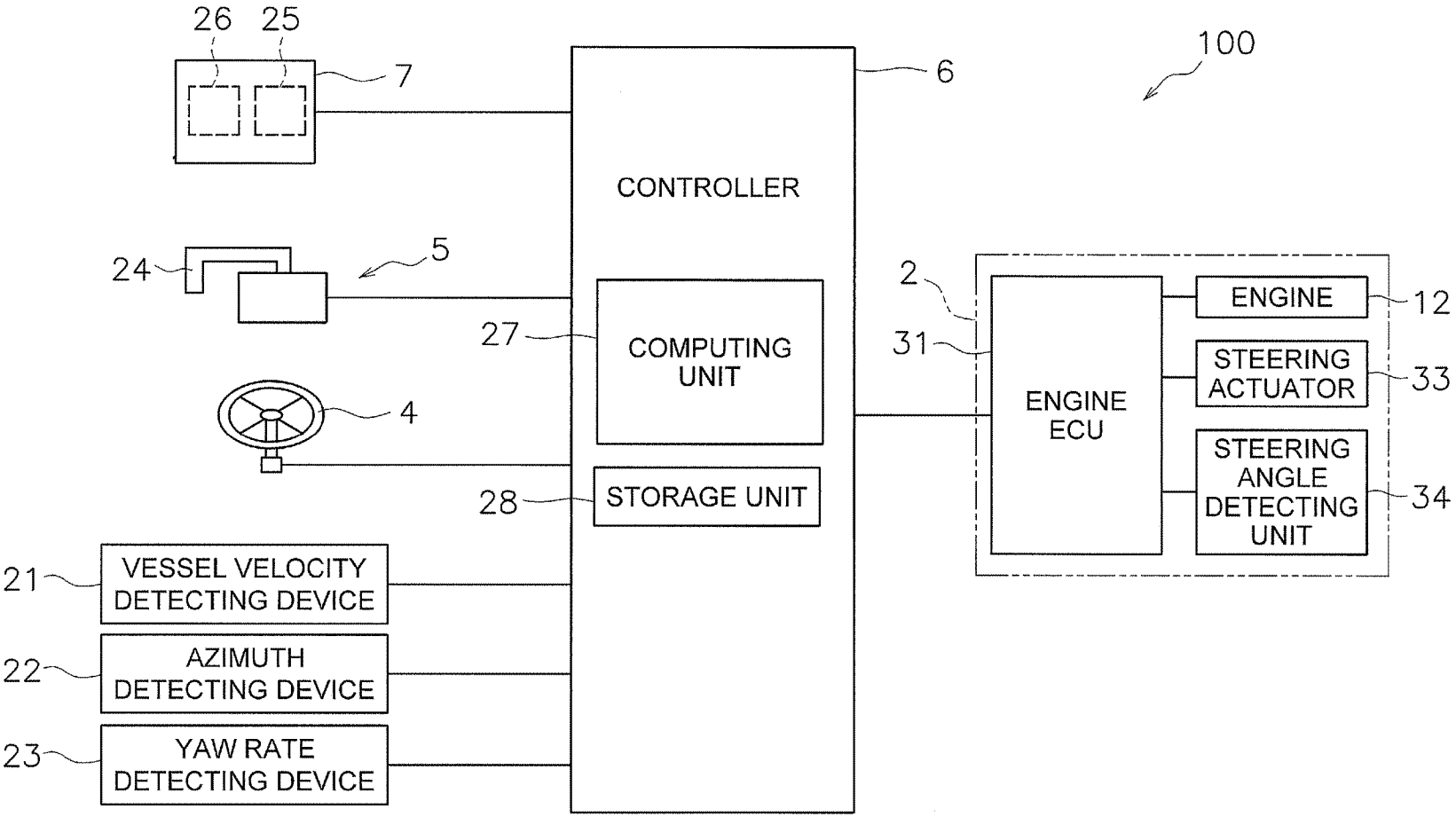
FIG. 3 is a schematic configuration diagram of a control system for a watercraft according to a first preferred embodiment of the present invention.

FIG. 3 is a schematic configuration diagram of a control system 100 for the watercraft 1 according to a first preferred embodiment of the present invention. The control system 100 includes the propulsion device 2, the steering handle 4, the remote controller 5, the controller 6 and the automatic cruise operator 7, which are described above, and also includes a vessel velocity detector 21, an azimuth detector 22 and a yaw rate detector 23.

The propulsion device 2 includes the engine 12, an engine ECU (electric control unit) 31, a steering actuator 33 and a steering angle detector 34.

The steering actuator 33 pivots the propulsion device 2 about the steering axis Ax1 of the bracket 15. Accordingly, the steering angle of the propulsion device 2 is changed. The steering actuator 33 causes the propulsion device 2 to perform a steering action such that the steering angle of the propulsion device 2 becomes a target steering angle to be described. The steering actuator 33 includes, for instance, a hydraulic cylinder.

The steering angle detector 34 detects an actual steering angle of the propulsion device 2. When the steering actuator 33 is a hydraulic cylinder, the steering angle detector 34 is, for instance, a stroke sensor for the hydraulic cylinder. The steering angle detector 34 transmits a detection signal indicating the detected actual steering angle to the engine ECU 31.

The engine ECU 31 stores a control program of the engine 12. The engine ECU 31 is configured or programmed to control the action of the engine 12 and that of the steering actuator 33 based on the signals from the steering handle 4 and the remote controller 5, the detection signal from the steering angle detector 34 and a detection signal from another sensor (not shown in the drawings) mounted to the propulsion device 2. The engine ECU 31 is connected to the controller 6 through a wired communication line. Alternatively, the engine ECU 31 may be connected to the controller 6 through a wireless communication line.

The remote controller 5 includes a throttle operator 24. The throttle operator 24 is, for instance, a lever that is able to be tilted down in the back-and-forth direction. An operating signal indicating an operation of the throttle operator 24 is transmitted to the controller 6. By operating the throttle operator 24, the operator is able to change back and forth the direction of the thrust to be generated by the propulsion device 2 and the engine rotation speed of the propulsion device 2.

The steering handle 4 is a member that sets the target steering angle of the propulsion device 2. The steering handle 4 is, for instance, a steering wheel. It should be noted that the steering handle 4 may be another type of device such as a joystick. The operating signal indicating the operation of the steering handle 4 is transmitted to the controller 6. When the operator operates the steering handle 4, the steering actuator 33 is driven in accordance with the operating signal. Accordingly, the operator is able to regulate the moving direction of the watercraft 1.

The automatic cruise operator 7 is a device that allows the operator to operate the automatic cruise function to be described. The automatic cruise operator 7 includes an automatic cruise command controller 25 and a target vessel velocity controller 26. The automatic cruise command controller 25 is configured or programmed to generate a command signal to activate the automatic cruise function. The target vessel velocity controller 26 is configured or programmed to set a target vessel velocity of the watercraft 1 in the automatic cruise function.

The automatic cruise operator 7 includes, for instance, a display and operating buttons. Alternatively, the automatic cruise operator 7 may include a display including a touch panel function and software keys displayed on the touch panel. By operating the operating buttons or the software keys, the operator is able to activate the automatic cruise function and is able to set the target vessel velocity of the watercraft 1. The command signal to activate the automatic cruise function and a command signal to indicate the set target vehicle velocity are transmitted to the controller 6.

The vessel velocity detector 21 detects an actual vessel velocity of the watercraft 1. The vessel velocity detector 21 includes, for instance, a receiver of a satellite navigation system such as a GPS. Alternatively, the vessel velocity detector 21 may include another type of device such as a pitot tube. A detection signal, indicating the actual vessel velocity of the watercraft 1 detected by the vessel velocity detector 21, is transmitted to the controller 6.

The azimuth detector 22 detects an azimuth of the watercraft 1. The azimuth detector 22 is, for instance, an electric compass. Alternatively, the azimuth detector 22 may be another type of device such as a gyroscope. A detection signal, indicating the azimuth of the watercraft 1 detected by the azimuth detector 22, is transmitted to the controller 6.

The yaw rate detector 23 detects a yaw rate of the watercraft 1. A detection signal, indicating the yaw rate of the watercraft 1 detected by the yaw rate detector 23, is transmitted to the controller 6.

The controller 6 includes a computer 27 and a storage 28. The computer 27 includes an arithmetic logic unit such as a CPU. The storage 28 includes semiconductor storage devices such as a RAM and a ROM, or alternatively, includes a hard disc drive, a flash memory or so forth. The storage 28 stores a program and data to control the propulsion device 2.

The controller 6 is configured or programmed to transmit a command signal to the engine ECU 31 based on the signal from the remote controller 5. Accordingly, the engine 12 is controlled. Additionally, the controller 6 is configured or programmed to transmit a command signal to the steering actuator 33 based on the signal from the steering handle 4. Accordingly, the steering actuator 33 is controlled.

The controller 6 is configured or programmed to perform an automatic cruise control when receiving the command signal to actuate the automatic cruise function from the automatic cruise command controller 25. In the automatic cruise control, the controller 6 controls the thrust of the propulsion device 2 such that a difference between the target vessel velocity set by the target vessel velocity controller 26 and the actual vessel velocity detected by the vessel velocity detector 21 falls in a predetermined range of values. Accordingly, the vessel velocity is kept in a predetermined velocity range including the target vessel velocity.

Additionally, the controller 6 is configured or programmed to determine whether or not a predetermined interruption condition has been established. When the interruption condition has been established, the controller 6 performs the automatic cruise control with a thrust having a different magnitude from that to be generated under normal circumstances, i.e., circumstances without establishment of the interruption condition. The automatic cruise control will be hereinafter explained in detail.

Figure 4:
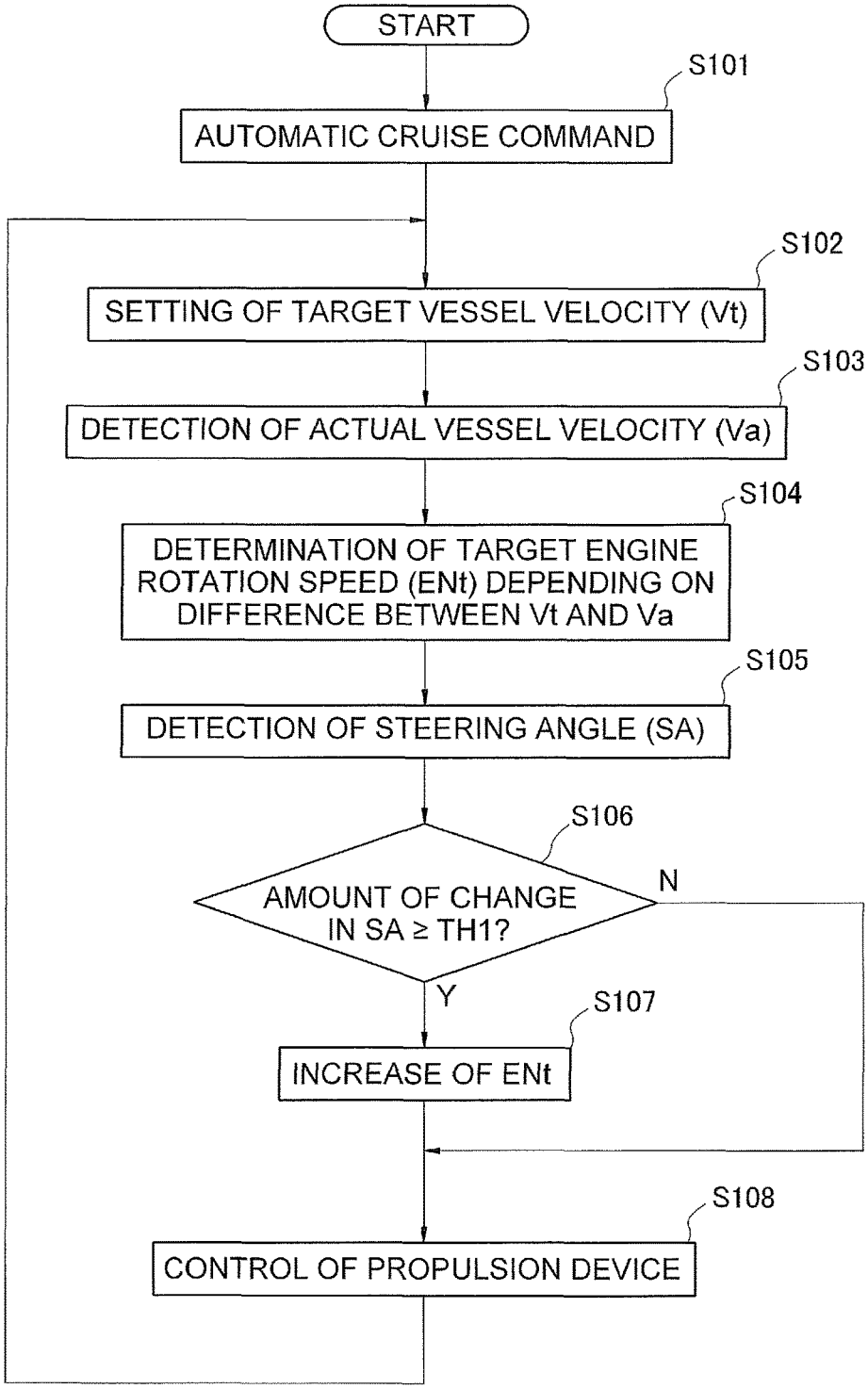
FIG. 4 is a flowchart showing a processing in an automatic cruise control according to the first preferred embodiment of the present invention.

FIG. 4 is a flowchart showing a processing to be performed in the automatic cruise control according to the first preferred embodiment. First, in Step S101, the controller 6 receives a command signal to actuate the automatic cruise function from the automatic cruise command controller 25. In Step S102, a target vessel velocity Vt is set. The controller 6 herein receives a command signal indicating the target vessel velocity Vt from the target vessel velocity controller 26, and sets the target vessel velocity Vt based on the received command signal. In Step S103, an actual vessel velocity Va is detected. The controller 6 herein receives a detection signal indicating the actual vessel velocity Va from the vessel velocity detector 21, and detects the actual vessel velocity Va based on the received detection signal.

In Step S104, a target engine rotation speed ENt is determined based on a difference between the target vessel velocity Vt and the actual vessel velocity Va. The controller 6 herein determines the target engine rotation speed ENt such that the difference between the target vessel velocity Vt and the actual vessel velocity Va falls in a predetermined range of values. A command signal indicating the determined target engine rotation speed ENt is transmitted to the propulsion device 2.

For example, the storage 28 stores data to define a relation between the target engine rotation speed ENt and the difference between the target vessel velocity Vt and the actual vessel velocity Va, and the controller 6 determines the target engine rotation speed ENt by referring to the data. A series of processing in Steps S102 to S104 are repeatedly performed, and by the feedback control, the controller 6 determines the target engine rotation speed ENt and controls the propulsion device 2.

In Step S105, a steering angle SA is detected. The controller 6 herein receives a detection signal indicating the steering angle SA of the propulsion device 2 from the steering angle detector 34, and detects the steering angle SA based on the received detection signal. In Step S106, it is determined whether or not the amount of change in steering angle SA is greater than or equal to predetermined threshold TH1. That the amount of change in steering angle SA is greater than or equal to the predetermined threshold TH1 is handled as the aforementioned interruption condition.

When the amount of change in steering angle SA is greater than or equal to the predetermined threshold TH1, the processing proceeds to Step S107. In Step S107, the target engine rotation speed ENt is increased. The controller 6 herein determines the value of the target engine rotation speed ENt to be higher than that of the target engine rotation speed ENt determined under the normal feedback control in Step S104. For example, the controller 6 increases the target engine rotation speed ENt by adding a predetermined rotation speed to the target engine rotation speed ENt determined under the normal feedback control in Step S104. The predetermined rotation speed herein added may be constant, or alternatively, may be increased or decreased in accordance with the amount of change in steering angle SA.

Then, in Step S108, the propulsion device 2 is controlled. The controller 6 herein transmits a command signal indicating the target engine rotation speed ENt to the ECU of the propulsion device 2. Accordingly, when the amount of change in steering angle SA becomes greater than or equal to the predetermined threshold TH1, the propulsion device 2 is controlled to generate a thrust having a larger magnitude than that to be generated under the normal circumstances even if the difference between the target vessel velocity Vt and the actual vessel velocity Va is not greater than or equal to a predetermined value.

Now back to Step S106, when the amount of change in steering angle SA is not greater than or equal to the predetermined threshold TH1, the processing proceeds to Step S108 without increasing the target engine rotation speed ENt in Step S107. In this case, the controller 6 transmits the command signal, indicating the target engine rotation speed ENt determined under the normal feedback control in Step S104, to the ECU of the propulsion device 2.

In the control system 100 for the watercraft 1 according to the present preferred embodiment explained above, when the amount of change in steering angle SA becomes greater than or equal to the predetermined threshold TH1, the interruption control to increase a thrust to be larger than that to be generated in the automatic cruise control under the normal feedback control is performed even if the difference between the target vessel velocity and the actual vessel velocity is not greater than or equal to the predetermined value. Accordingly, the thrust is able to be increased before the vessel velocity is greatly decreased by a turning action of the watercraft 1. Hence, it is possible to inhibit decrease in vessel velocity attributed to turning of the watercraft 1 during the automatic cruise control. Alternatively, when the vessel velocity has actually decreased, the decreased vessel velocity is able to be quickly restored.

Figure 5A:
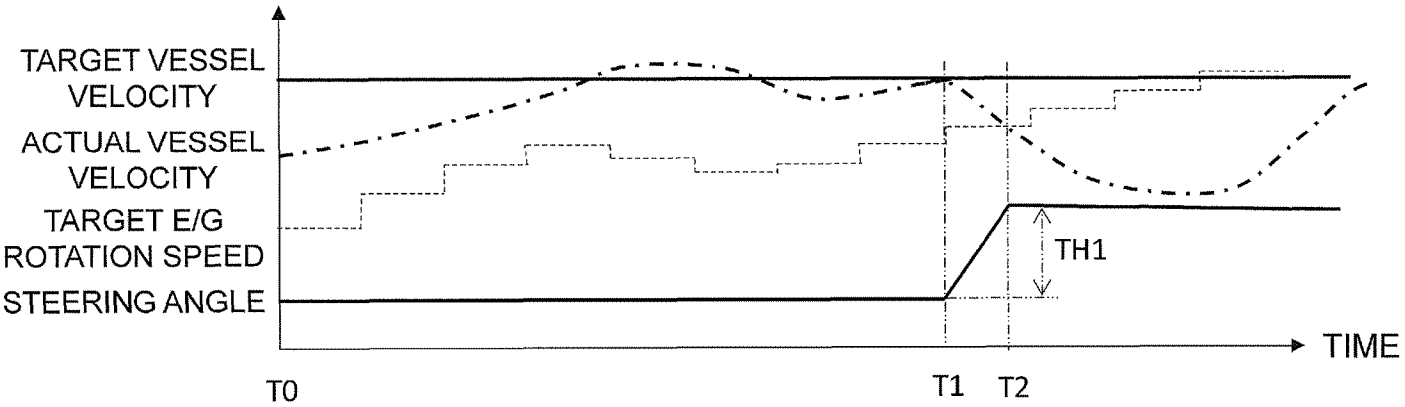
FIGS. 5A and 5B includes timing charts respectively showing variations in target vessel velocity, actual vessel velocity, target engine rotation speed, and steering angle during the automatic cruise control.
Figure 5B:
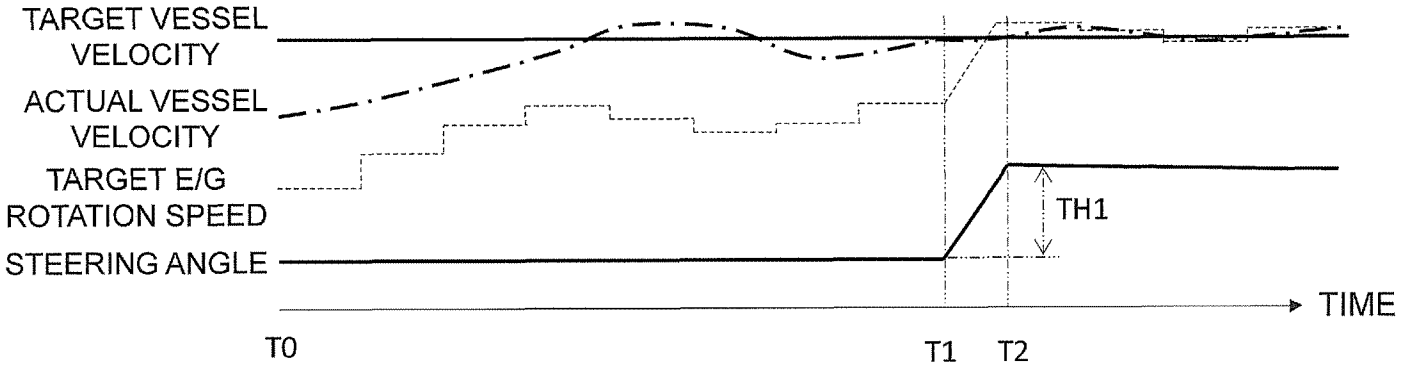

For example, FIGS. 5A and 5B are timing charts respectively showing variations in target vessel velocity, actual vessel velocity, target engine rotation speed, and steering angle during the automatic cruise control. FIG. 5A shows an automatic cruise control in a comparative example in which the aforementioned interruption control is not performed. FIG. 5B shows the automatic cruise control in the present preferred embodiment.

In a period from time T0 to time T1, the steering angle is constant, and the automatic cruise control is performed under the normal feedback control in both of the comparative example and the present preferred embodiment. Accordingly, the target engine rotation speed is regulated such that the difference between the target vessel velocity and the actual vessel velocity falls in a predetermined range of values.

In a period from time T1 to time T2, the steering angle is changed by the predetermined threshold TH1 or greater. At this time, a portion of the thrust of the propulsion device 2 is used to turn the watercraft 1, but in the automatic cruise control according to the comparative example, the normal feedback control is continued similarly to the period from time T0 to time T1. Due to this, the actual vessel velocity greatly decreases. Then, at and after time T2, the actual vessel velocity gradually approaches to the target vessel velocity by the normal feedback control.

In contrast, in the automatic cruise control according to the present preferred embodiment, when the steering angle is changed by the predetermined threshold TH1 or greater in the period from time T1 to time T2, the target engine rotation speed is increased to be higher than that to be determined in the normal feedback control. Accordingly, decrease in actual vessel velocity is prevented in the period from time T1 to time T2.

It should be noted that in the aforementioned preferred embodiment, whether the amount of change in steering angle is greater than or equal to the predetermined threshold TH1 is handled as the interruption condition. However, another condition may be handled as the interruption condition as long as it indicates that the operating amount of the steering mechanism in the watercraft 1 is greater than or equal to a predetermined operating threshold. For example, whether the operating amount of the steering handle 4 is greater than or equal to a predetermined operating threshold may be handled as the interruption condition.

Figure 6:
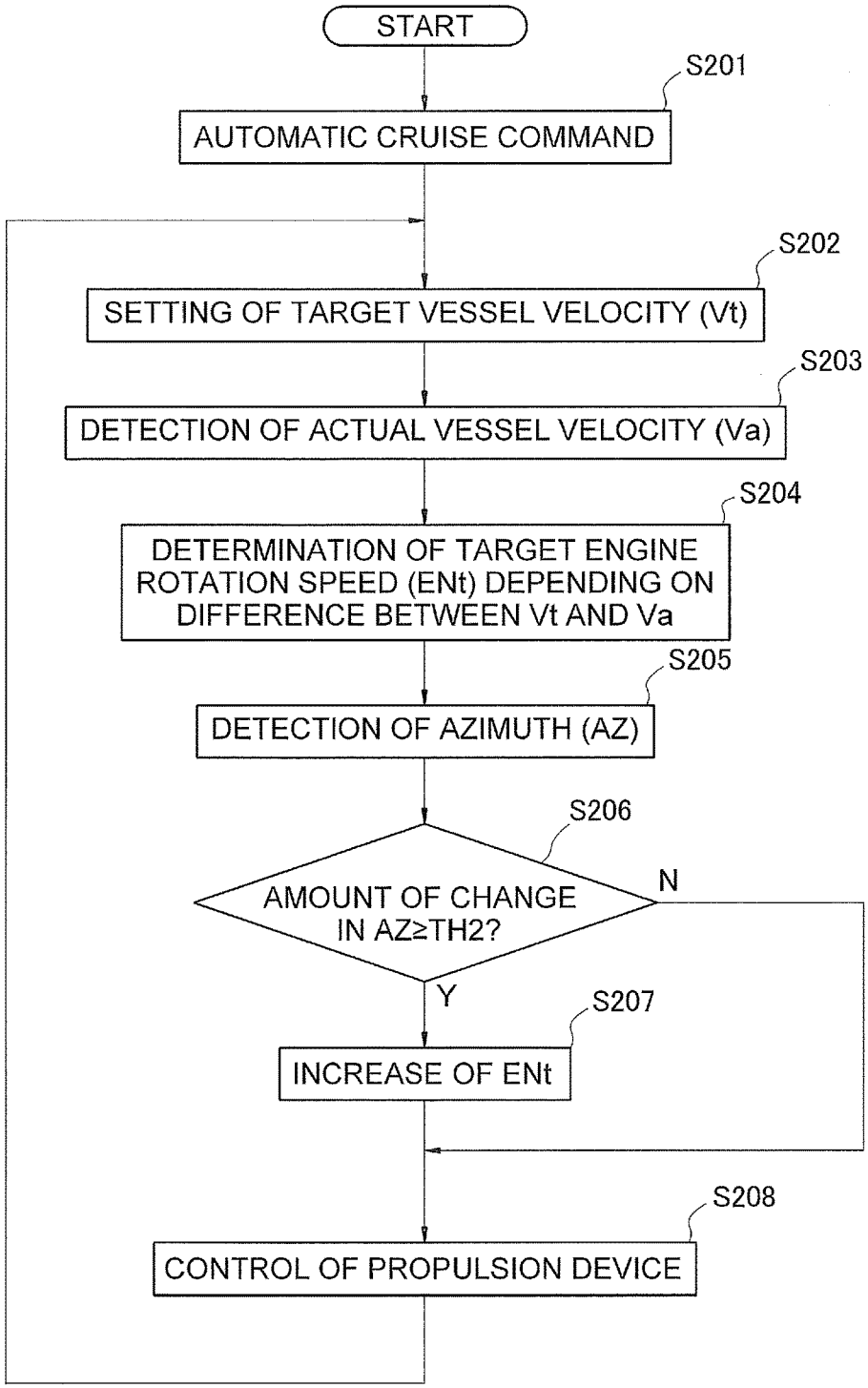
FIG. 6 is a flowchart showing a processing in an automatic cruise control according to a first modification of a preferred embodiment of the present invention.

FIG. 6 is a flowchart showing a processing of an automatic cruise control according to a first modification of a preferred embodiment of the present invention. In the automatic cruise control according to the first modification, an azimuth Az of the watercraft 1 is detected in Step S205. The controller 6 herein receives a detection signal indicating the azimuth Az of the watercraft 1 from the azimuth detector 22, and detects the azimuth Az of the watercraft 1 based on the detection signal.

In Step S206, it is determined whether or not the amount of change in azimuth Az is greater than or equal to a predetermined threshold TH2. In other words, that the amount of change in azimuth Az is greater than or equal to the predetermined threshold TH2 may be handled as the interruption condition. The other steps S201 to 204, 207 and 208 are the same as the aforementioned steps S101 to 104, 107 and 108, and therefore, will not be hereinafter explained.

Figure 7:
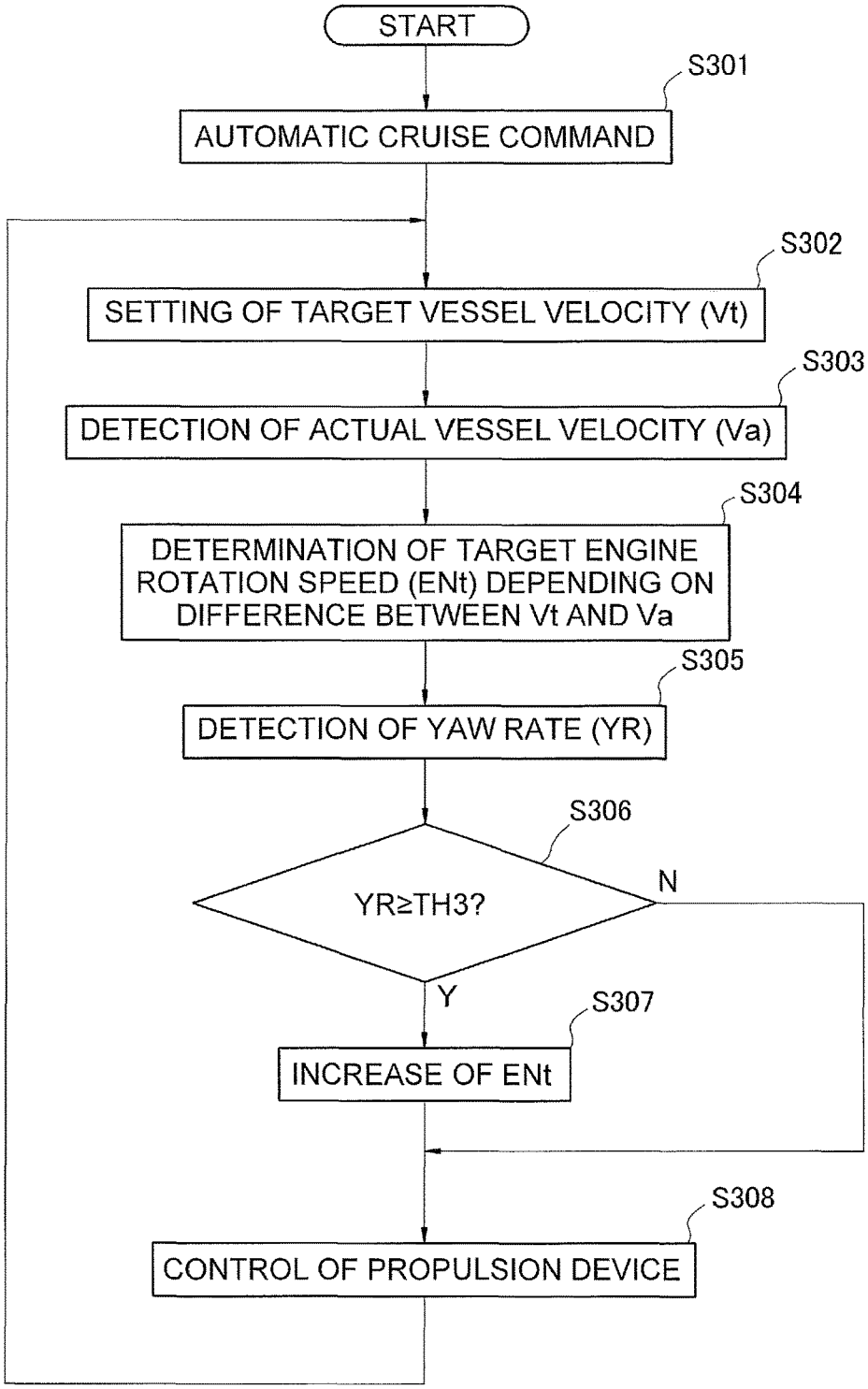
FIG. 7 is a flowchart showing a processing in an automatic cruise control according to a second modification of a preferred embodiment of the present invention.

FIG. 7 is a flowchart showing a processing of an automatic cruise control according to a second modification of a preferred embodiment of the present invention. In the automatic cruise control according to the second modification, a yaw rate YR of the watercraft 1 is detected in Step S305. The controller 6 receives a detection signal indicating the yaw rate YR of the watercraft 1 from the yaw rate detector 23, and detects the yaw rate YR of the watercraft 1 based on the detection signal. In Step S306, it is determined whether or not the yaw rate YR is greater than or equal to a predetermined threshold TH3. In other words, that the yaw rate YR is greater than or equal to the predetermined threshold TH3 may be handled as the interruption condition. The other steps S301 to 304, 307 and 308 are the same as the aforementioned steps S101 to 104, 107 and 108, and therefore, will not be hereinafter explained.

Figure 8:
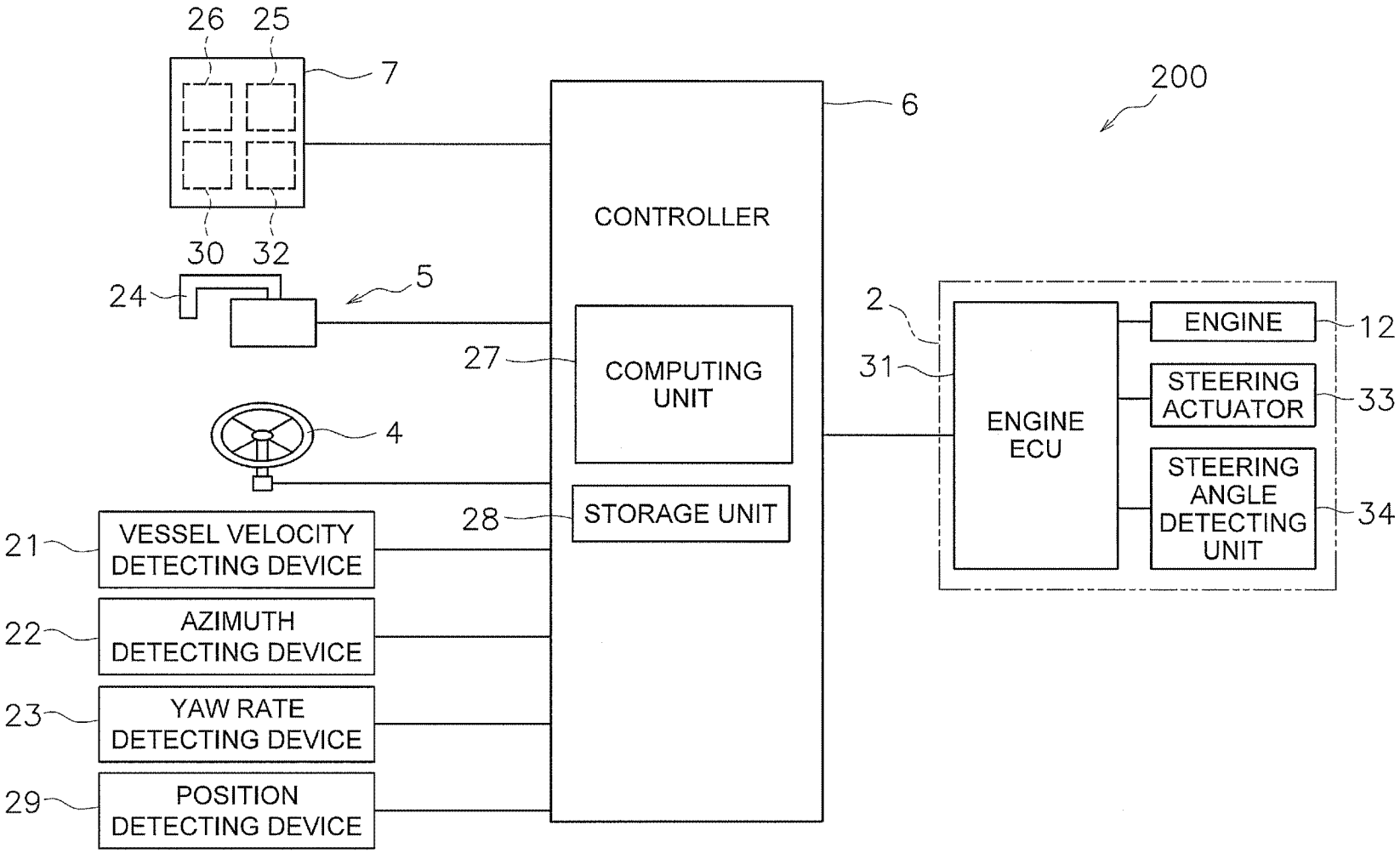
FIG. 8 is a schematic configuration diagram of a control system for a watercraft according to a second preferred embodiment of the present invention.

Next, a control system 200 for the watercraft 1 according to a second preferred embodiment of the present invention will be explained. FIG. 8 is a schematic configuration diagram of the control system 200 for the watercraft 1 according to the second preferred embodiment. As shown in FIG. 8, a position detector 29 is mounted to the watercraft 1. The position detector 29 includes a receiver of a satellite navigation system such as a GPS, for instance, and detects the present position of the watercraft 1. A detection signal, indicating the present position of the watercraft 1 detected by the position detector 29, is transmitted to the controller 6.

The automatic cruise operator 7 includes a destination setting device 30. The destination setting device 30 is a device that allows the operator to set a destination of the watercraft 1. For example, the operator is able to set a destination of the watercraft 1 by specifying the destination through a map displayed on the display of the automatic cruise operator 7. Alternatively, the operator is able to set a destination of the watercraft 1 by inputting the coordinates of the destination to the automatic cruise operator 7. A command signal, indicating the destination set by the destination setting device 30, is transmitted to the controller 6.

The automatic cruise operator 7 includes a map information storage 32. The map information storage 32 stores map information containing a cruising route of the watercraft 1. The map information storage 32 may be a memory embedded in the automatic cruise operator 7. Alternatively, the map information storage 32 may be a recording medium designed to be connected to the automatic cruise operator 7.

In the second preferred embodiment, when receiving the command signal to actuate the automatic cruise function, the controller 6 controls the propulsion device 2 such that the watercraft 1 automatically reaches the destination. Additionally, when the predetermined interruption condition has been established, the controller 6 decreases a thrust to be smaller than that to be generated under the normal circumstances.

Figure 9:
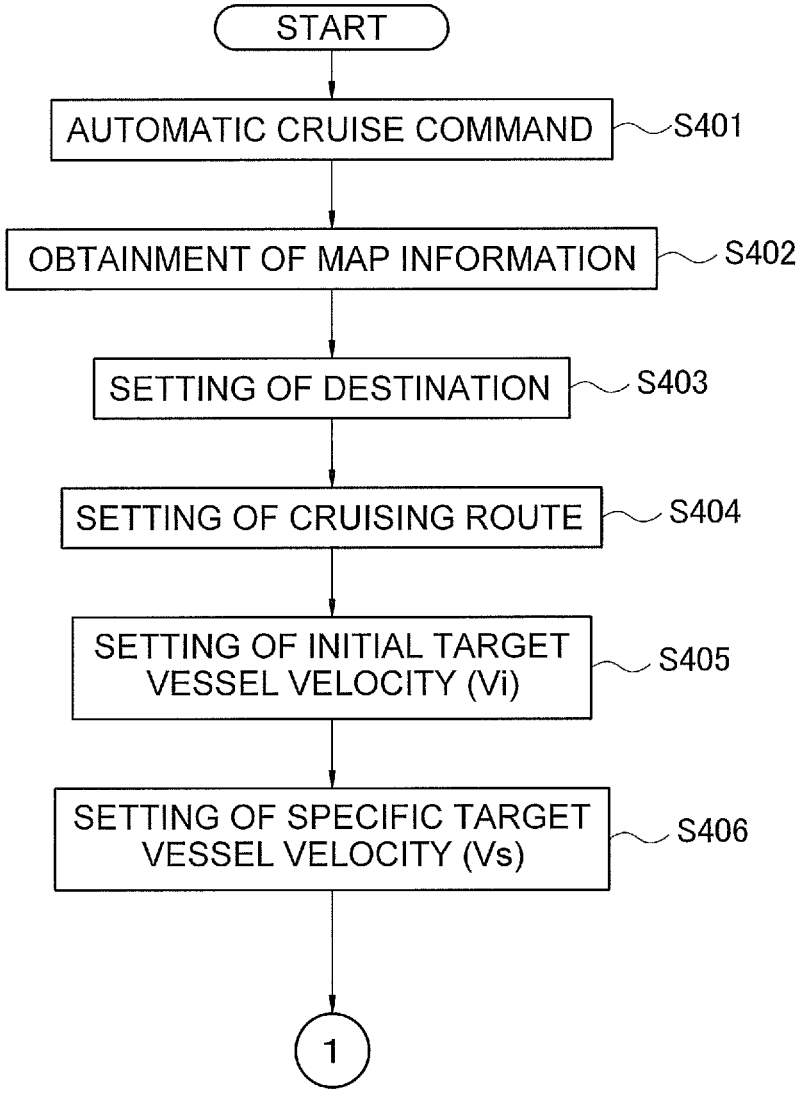
FIG. 9 is a flowchart showing a portion of a processing in an automatic cruise control according to the second preferred embodiment of the present invention.
Figure 10:
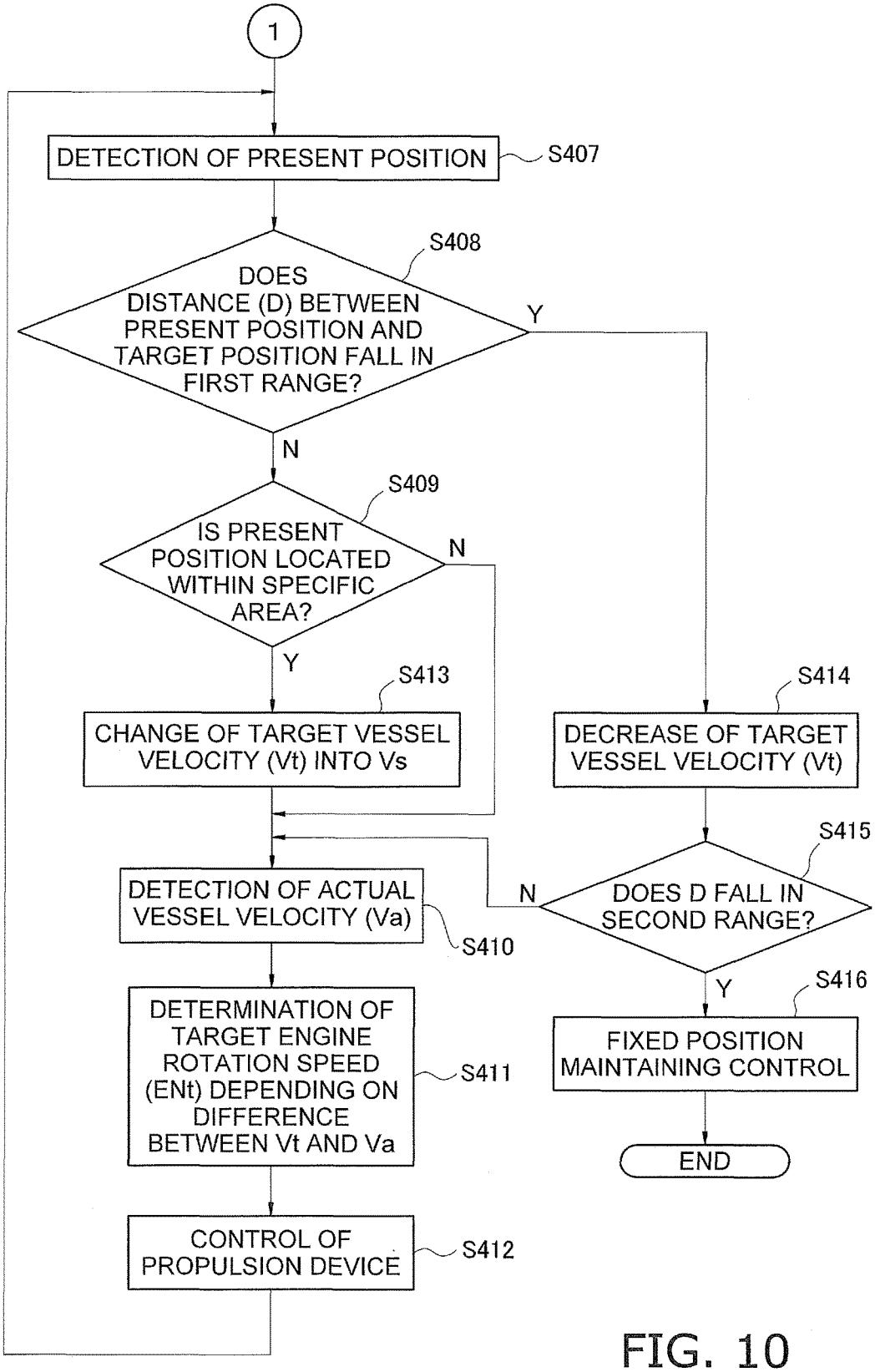
FIG. 10 is a flowchart showing the remaining portion of the processing in the automatic cruise control according to the second preferred embodiment of the present invention.

FIGS. 9 and 10 are flowcharts showing a series of processing of an automatic cruise control according to the second preferred embodiment.

As shown in FIG. 9, in Step S401, the controller 6 receives the command signal to actuate the automatic cruise function from the automatic cruise command controller 25. In Step S402, the map information is obtained. The controller 6 herein receives a signal indicating the map information from the map information storage 32. In Step S403, a destination of the watercraft 1 is set. The controller 6 herein receives a command signal indicating the destination from the destination setting device 30, and sets the destination of the watercraft 1 based on the command signal. In Step S404, a cruising route is set. The controller 6 herein determines the cruising route based on the destination and the map information.

In Step S405, an initial target vessel velocity Vi is set. The controller 6 herein receives a command signal indicating the initial target vessel velocity Vi from the target vessel velocity controller 26, and sets the initial target vessel velocity Vi based on the command signal. In Step S406, a specific target vessel velocity Vs is set. The specific target vessel velocity Vs is a target vessel velocity in a specific area on the cruising route of the watercraft 1. The aforementioned map information contains the specific area and information indicating the specific target vessel velocity Vs in the specific area. The controller 6 sets the specific area and the specific target vessel velocity Vs based on the map information. Alternatively, similarly to the initial target vessel velocity Vi, the specific target vessel velocity Vs may be set by the target vessel velocity controller 26.

As shown in FIG. 10, in Step S407, the present position of the watercraft 1 is detected. The controller 6 herein receives a detection signal indicating the present position of the watercraft 1 from the position detector 29, and detects the present position of the watercraft 1 based on the detection signal. In Step S408, it is determined whether or not a distance D between the present position and the destination falls in a predetermined first range. That the distance D between the present position and the destination falls in the predetermined first range indicates that the watercraft 1 has approached the destination, and is handled as the interruption condition, based on which a thrust is decreased to be smaller than that to be generated under the normal circumstances. When the distance D between the present position and the destination does not fall in the predetermined first range, the processing proceeds to Step S409.

In Step S409, it is determined whether or not the present position is located in the specific area. The controller 6 herein determines whether or not the present position is located in the specific area by comparing the present position of the watercraft 1 detected by the position detector 29 and the location of the specific area contained in the map information stored in the map information storage 32. That the present position is located in the specific area is handled as the interruption condition, based on which a thrust is decreased to be smaller than that to be generated under the normal circumstances.

When the present position is not located in the specific area, the processing proceeds to Step S410. In Step S410, the actual vessel velocity Va is detected. In Step S411, the target engine rotation speed ENt is determined based on the difference between the target vessel velocity Vt and the actual vessel velocity Va. When the present position is not located in the specific area in Step S409, the target vessel velocity Vt in Step S411 is the initial target vessel velocity Vi set in Step S405. Therefore, the controller 6 determines the target engine rotation speed ENt such that the difference between the initial target vessel velocity Vi and the actual vessel velocity Va falls in a predetermined range of values. The controller 6 transmits a command signal, indicating the target engine rotation ENt determined herein, to the propulsion device 2. Accordingly, in Step S412, the propulsion device 2 is controlled such that the watercraft 1 is able to cruise at the initial target vessel velocity Vi toward the destination.

When the present position is located in the specific area in Step S409, the processing proceeds to Step S413. In Step S413, the target vessel velocity Vt is changed from the initial target vessel velocity Vi to the specific target vessel velocity Vs. Accordingly, when the present position is located in the specific area in Step S409, the target vessel velocity Vt in Step S411 is the specific target vessel velocity Vs set in Step S406. Therefore, when the present position is located in the specific area, the controller 6 determines the target engine rotation speed ENt such that the difference between the specific target vessel velocity Vs and the actual vessel velocity Va falls in a predetermined range of values. Then in Step S412, the propulsion device 2 is controlled such that the watercraft 1 is able to cruise at the specific target vessel velocity Vs in the specific area.

In Step S408, when the distance D between the present position and the destination falls in the predetermined first range, the processing proceeds to Step S414. In Step S414, the target vessel velocity Vt is decreased to be lower than the initial target vessel velocity Vi set in Step S405.

In Step S415, it is determined whether or not the distance D between the present position and the destination falls in a predetermined second range. The second range is a range narrower than the first range. That the distance D between the present position and the destination falls in the predetermined second range indicates that the watercraft 1 has approximately reached the destination, and is handled as the interruption condition, based on which a thrust is decreased to be smaller than that to be generated under the normal circumstances. When the distance D between the present position and the destination does not fall in the predetermined second range, the processing proceeds to Step S410. When the distance D between the present position and the destination falls in the predetermined second range, the processing proceeds to Step S416.

In Step S416, the automatic cruise control is stopped, and a fixed location maintaining control is performed. In the fixed location maintaining control, the target vessel velocity Vt is set to be 0, for instance, and the propulsion device 2 is controlled to make the watercraft 1 stay in the destination.

In the control system for the watercraft 1 according to the present preferred embodiment, the target vessel velocity is changed from the initial target vessel velocity to the specific target vessel velocity when the watercraft 1 is located in the specific area. For example, when the specific area is a harbor or a speed limit zone, the specific target vessel velocity is preferably set to be a speed limit assigned in the harbor or the speed limit zone. Accordingly, even when the initial target vessel velocity is higher than the speed limit, the propulsion device 2 is automatically controlled such that the watercraft 1 decelerates to the speed limit or less in entering the specific area.

Additionally, in the control system for the watercraft 1 according to the present preferred embodiment, the propulsion device 2 is automatically controlled to decelerate the watercraft 1 when the watercraft 1 approaches to the destination and the distance between the present position of the watercraft 1 and the destination falls in the first range. Then, when the distance between the present position of the watercraft 1 and the destination falls in the second range and thus the watercraft 1 approximately reaches the destination, the propulsion device 2 is automatically controlled to make the watercraft 1 stay in the destination by the fixed location maintaining control. Accordingly, it is possible to accurately navigate the watercraft 1 to the destination.

Figure 11:
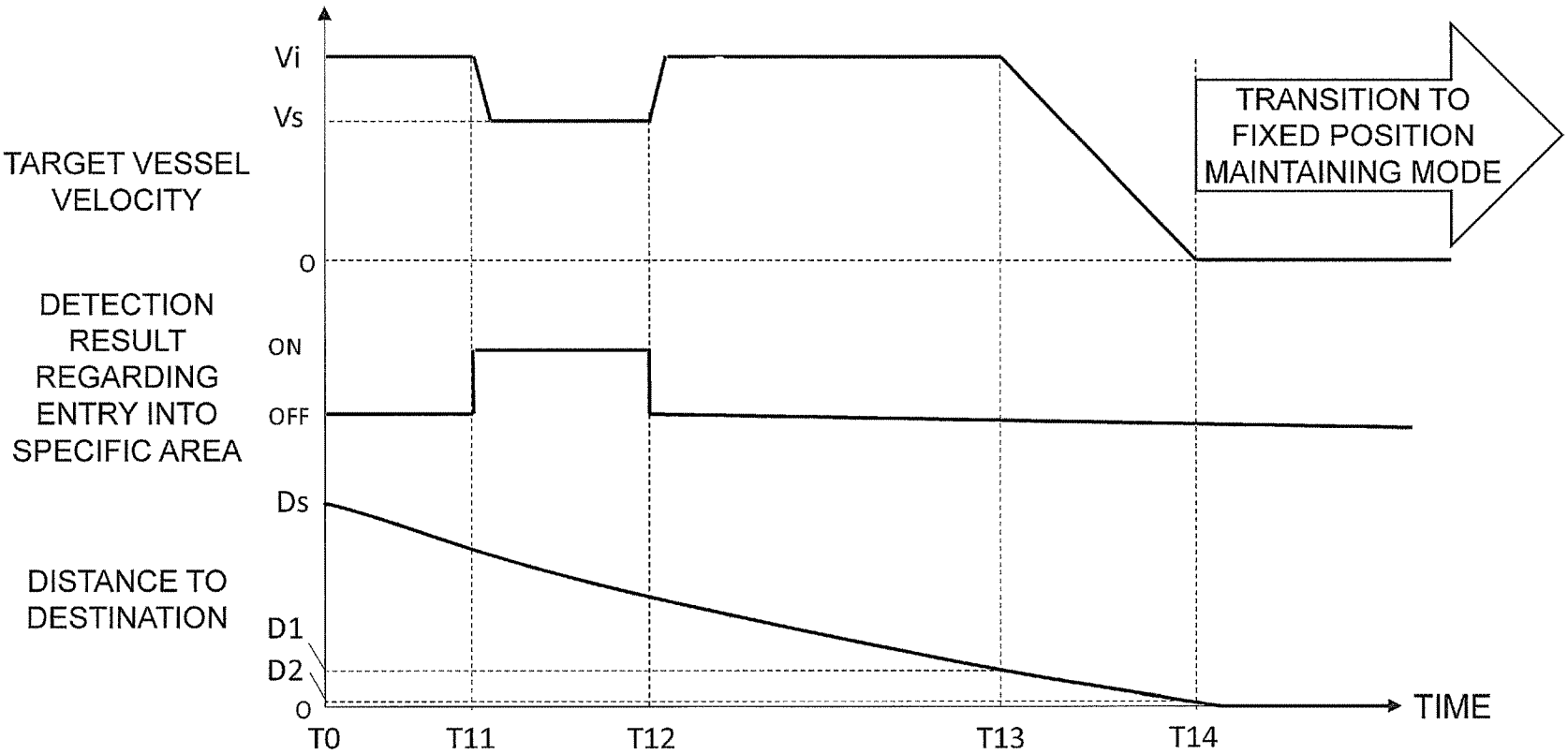
FIG. 11 is a timing chart showing variations in target vessel velocity, detection results regarding entry into a specific area, and distance to a destination during the automatic cruise control according to the second preferred embodiment of the present invention.

For example, FIG. 11 is a timing chart showing variations in target vessel velocity, detection results regarding entry into a specific area, and distances to a destination during the automatic cruise control according to the second preferred embodiment. The item "detection results regarding entry into a specific area" herein means the results of the aforementioned Step S409 to determine whether or not the present position is located in the specific area. When the present position is located in the specific area, the detection result regarding entry into the specific area is set to be "ON". When the present position is located out of the specific area, the detection result regarding entry into the specific area is set to be "OFF".

At time T0, distance to a destination is Ds, and the target vessel velocity is set to be the initial target vessel velocity Vi. At this time, the present position is located out of the specific area, and the detection result regarding entry into the specific area is set to be "OFF". At time T0, the controller 6 performs the automatic cruise control, and accordingly, the watercraft 1 starts cruising toward the destination in accordance with a set cruising route.

When the watercraft 1 enters the specific area at time T11, the detection result regarding entry into the specific area is set to be "ON" and the target vessel velocity is decreased to the specific target vessel velocity Vs. In a period from time T11 to time T12, the watercraft 1 is located in the specific area, and meanwhile, the target vessel velocity is kept at the specific target vessel velocity Vs.

When the watercraft 1 exits the specific area at time T12, the detection result regarding entry into the specific area is set to be "OFF" and the target vessel velocity is restored to the initial target vessel velocity Vi.

When the watercraft 1 further cruises toward the destination and then the distance to the destination falls in the first range (of distance D1 or less) at time T13, the target vessel velocity is decreased. In a period from time T13 to time T14, the target vessel velocity is gradually decreased in accordance with reduction in distance to the destination. When the distance to the destination then falls in the second range (of distance D2 or less) at time T14, the target vessel velocity is set to be 0. At or after time T14, the watercraft 1 is controlled to stay in the destination by the aforementioned fixed location maintaining control.

It should be noted that in the aforementioned preferred embodiments, the target vessel velocity is preferably set to be the specific target vessel velocity Vs when the watercraft 1 enters the specific area. However, the target vessel velocity may be changed stepwise in accordance with distance between the present position and a specific place (e.g., a specific area on a cruising route). Alternatively, the target vessel velocity may be set to be the specific target vessel velocity Vs when the watercraft 1 reaches not the specific area but a specific position.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft control method, comprising the steps of:

receiving a command signal to activate an automatic cruise function;

setting a target vessel velocity of the watercraft;

obtaining an actual vessel velocity of the watercraft;

generating a command signal to perform an automatic cruising control to control a thrust of the watercraft such that a difference between the target vessel velocity and the actual vessel velocity falls in a predetermined range of values;

determining whether or not a predetermined interruption condition has been established; and generating a command signal to perform the automatic cruise control with the thrust having a different magnitude from the thrust to be generated under normal circumstances without establishment of the interruption condition when the interruption condition has been established; wherein when the interruption condition has been established, a target rotation speed of an engine of the watercraft is increased to be higher than the target rotation speed determined under the normal circumstances.

2. The watercraft control method according to claim 1, wherein the interruption condition is a condition indicating that an operating amount of a steering mechanism of the watercraft is greater than or equal to a predetermined operating threshold; and when the interruption condition has been established, the thrust of the watercraft is increased to be larger than the thrust to be generated under the normal circumstances.

3. The watercraft control method according to claim 1, further comprising the step of:

obtaining a yaw rate of the watercraft; wherein the interruption condition is a condition indicating that the yaw rate is greater than or equal to a predetermined value; and when the interruption condition has been established, the thrust is increased to be larger than the thrust to be generated under the normal circumstances.

4. A watercraft control method, comprising the steps of:

receiving a command signal to activate an automatic cruise function;

setting a target vessel velocity of the watercraft;

obtaining an actual vessel velocity of the watercraft;

generating a command signal to perform an automatic cruising control to control a thrust of the watercraft such that a difference between the target vessel velocity and the actual vessel velocity falls in a predetermined range of values;

determining whether or not a predetermined interruption condition has been established;

generating a command signal to perform the automatic cruise control with the thrust having a different magnitude from the thrust to be generated under normal circumstances without establishment of the interruption condition when the interruption condition has been established; and obtaining an azimuth of the watercraft; wherein the interruption condition is a condition indicating that an amount of change in the azimuth is greater than or equal to a predetermined value; and when the interruption condition has been established, the thrust of the watercraft is increased to be larger than the thrust to be generated under the normal circumstances.

5. A watercraft control method, comprising the steps of:
receiving a command signal to activate an automatic cruise function;
setting a target vessel velocity of the watercraft;
obtaining an actual vessel velocity of the watercraft;
generating a command signal to perform an automatic cruising control to control a thrust of the watercraft such that a difference between the target vessel velocity and the actual vessel velocity falls in a predetermined range of values;
determining whether or not a predetermined interruption condition has been established;
generating a command signal to perform the automatic cruise control with the thrust having a different magnitude from the thrust to be generated under normal circumstances without establishment of the interruption condition when the interruption condition has been established;
setting a destination of the watercraft; and
obtaining a present position of the watercraft; wherein
the interruption condition is a condition indicating that a distance between the present position and the destination falls in a predetermined first range; and
when the interruption condition has been established, the thrust is decreased to be smaller than the thrust to be generated under the normal circumstances.

6. The watercraft control method according to claim 5, wherein when the interruption condition has been established, the target vessel velocity is decreased to be lower than the target vessel velocity to be determined under the normal circumstances.

7. The watercraft control method according to claim 5, wherein the thrust is decreased stepwise in accordance with the distance between the present position and the destination.

8. The watercraft control method according to claim 5, further comprising the step of:
generating a command signal to stop the automatic cruise control and performing a fixed location maintaining control to control the thrust of the watercraft such that the watercraft stays in the destination when the distance between the present position and the destination falls in a second range narrower than the first range.

9. A watercraft control method, comprising the steps of:
receiving a command signal to activate an automatic cruise function;
setting a target vessel velocity of the watercraft;
obtaining an actual vessel velocity of the watercraft;
generating a command signal to perform an automatic cruising control to control a thrust of the watercraft such that a difference between the target vessel velocity and the actual vessel velocity falls in a predetermined range of values;
determining whether or not a predetermined interruption condition has been established;
generating a command signal to perform the automatic cruise control with the thrust having a different magnitude from the thrust to be generated under normal circumstances without establishment of the interruption condition when the interruption condition has been established; and
setting a specific target vessel velocity in a specific place on a cruising route of the watercraft; wherein
the interruption condition is a condition indicating that the watercraft has reached the specific place; and
when the interruption condition has been established, the target vessel velocity is changed into the specific target vessel velocity.

10. The watercraft control method according to claim 9, wherein the specific place is a specific area on the cruising route of the watercraft.

11. The watercraft control method according to claim 9, further comprising the step of:
obtaining map information containing the cruising route of the watercraft; wherein
the specific place is set based on the map information.

12. The watercraft control method according to claim 9, further comprising the step of:
obtaining a present position of the watercraft; wherein
the target vessel velocity is changed stepwise in accordance with a distance between the present position and the specific place.

13. A watercraft control system, comprising:
a propulsion device mounted to a watercraft;
an automatic cruise command controller configured or programmed to generate a command signal to activate an automatic cruise function;
a target vessel velocity controller configured or programmed to set a target vessel velocity of the watercraft;
a vessel velocity detector that detects an actual vessel velocity of the watercraft; and
a controller configured or programmed to perform an automatic cruise control to control a thrust of the propulsion device such that a difference between the target vessel velocity and the actual vessel velocity falls in a predetermined range of values, determine whether or not a predetermined interruption condition has been established, and perform the automatic cruise control with the thrust having a different magnitude from the thrust to be generated under normal circumstances without establishment of the interruption condition when the interruption condition has been established; wherein
when the interruption condition has been established, the controller increases a target rotation speed of an engine of the watercraft to be higher than the target rotation speed determined under the normal circumstances.

* * * * *